US011027510B2

(12) United States Patent
Fukuda et al.

(10) Patent No.: US 11,027,510 B2
(45) Date of Patent: Jun. 8, 2021

(54) SHEET-CUTTING DEVICE, METHOD FOR CUTTING SHEET, AND NON-TRANSITORY COMPUTER READABLE RECORDING MEDIUM

(71) Applicant: Nihon Seizuki Kogyo Co., Ltd., Osaka (JP)

(72) Inventors: Masanori Fukuda, Osaka (JP); Toshiro Ochi, Osaka (JP)

(73) Assignee: Nihon Seizuki Kogyo Co., Ltd., Osaka (JP)

( * ) Notice: Subject to any disclaimer, the term of this patent is extended or adjusted under 35 U.S.C. 154(b) by 295 days.

(21) Appl. No.: 15/573,123

(22) PCT Filed: Dec. 8, 2016

(86) PCT No.: PCT/JP2016/086543
§ 371 (c)(1),
(2) Date: Nov. 9, 2017

(87) PCT Pub. No.: WO2017/099178
PCT Pub. Date: Jun. 15, 2017

(65) Prior Publication Data

US 2018/0086018 A1 Mar. 29, 2018

(30) Foreign Application Priority Data

Dec. 8, 2015 (JP) ..... 2015-239190
Sep. 7, 2016 (JP) ..... JP2016-174898

(51) Int. Cl.
*B31B 50/00* (2017.01)
*B26D 1/04* (2006.01)
(Continued)

(52) U.S. Cl.
CPC ..... *B31B 50/006* (2017.08); *B26D 1/04* (2013.01); *B26D 5/00* (2013.01); *B26D 5/007* (2013.01);
(Continued)

(58) Field of Classification Search
CPC ..... B31B 50/006; B31B 50/25; B31B 50/20; B31B 50/04; B31B 50/14; B31B 50/144;
(Continued)

(56) References Cited

U.S. PATENT DOCUMENTS 3,611,884 A * 10/1971 Hottendorf ..... B31F 1/10 493/55
6,131,498 A * 10/2000 Gerber ..... B26D 1/10 30/393
(Continued)

FOREIGN PATENT DOCUMENTS

DE 19620391 A1 11/1997
EP 0768046 A1 4/1997
(Continued)

OTHER PUBLICATIONS

Office Action dated Apr. 8, 2019 for European Patent Application Serial No. 16873071.1.
(Continued)

*Primary Examiner* — Thomas M Wittenschlaeger
(74) *Attorney, Agent, or Firm* — K&L Gates LLP; Louis C. Cullman; Georgia N. Kefallinos

(57) ABSTRACT

A sheet processing apparatus (1) includes a first processing section (1000), a second processing section (2000), and a third processing section (3000) arranged on a straight line, and conveys a sheet (4200) therebetween. The first processing section (1000) forms a plurality of first processing lines extending in a first direction (an X axial direction) on the sheet (4200), by moving a plurality of tools (1110-1260) to
(Continued)

sheet processing apparatus 1 the first direction in relation to the sheet (4200). The second processing section (2000) forms a plurality of second processing lines to a second direction (a Y axial direction) orthogonal to the first direction on the sheet (4200), by moving a plurality of tools to the second direction in relation to the sheet (4200). The third processing section (3000) forms a third processing line (aslant line, curve line) on the sheet, by relatively moving the sheet (4200) and the tool (3110, 3120).

8 Claims, 5 Drawing Sheets

(51) Int. Cl.

| | |
|---|---|
| ***B26D 11/00*** | (2006.01) |
| ***B26D 5/00*** | (2006.01) |
| ***B31B 50/04*** | (2017.01) |
| ***B31B 50/20*** | (2017.01) |
| ***B31B 50/25*** | (2017.01) |
| ***B26F 1/38*** | (2006.01) |

(52) U.S. Cl.
CPC ..... *B26D 11/00* (2013.01); *B26F 1/3813* (2013.01); *B31B 50/04* (2017.08); *B31B 50/20* (2017.08); *B31B 50/25* (2017.08); *B26F 2001/388* (2013.01)

(58) Field of Classification Search
CPC ..... B31B 50/142; B31B 50/18; B31B 50/252; B31B 50/254; B31B 70/20; B26D 1/04; B26D 5/007; B26D 11/00; B26D 2005/002; B26D 2005/005; B26D 5/00; B31F 2201/0779; B26F 1/3813; B26F 2001/388
USPC ..... 493/53, 59, 60, 161
See application file for complete search history.

(56) References Cited

U.S. PATENT DOCUMENTS

| | | | | |
|---|---|---|---|---|
| 8,353,236 | B2 * | 1/2013 | De Marco | B26D 1/405 83/492 |
| 2004/0149378 | A1 | 8/2004 | Cummings et al. | |
| 2004/0173068 | A1 * | 9/2004 | Adachi | B26D 11/00 83/13 |
| 2011/0100178 | A1 * | 5/2011 | Tanaka | B25J 11/006 83/78 |
| 2011/0152048 | A1 * | 6/2011 | Gombert | B23K 26/0648 493/53 |
| 2012/0330449 | A1 * | 12/2012 | Edwards | B26D 5/00 700/97 |
| 2013/0045847 | A1 * | 2/2013 | Capoia | B26D 7/2635 493/59 |
| 2014/0238214 | A1 | 8/2014 | Finken | |
| 2015/0148210 | A1 * | 5/2015 | Sibthorpe | B41J 3/407 493/324 |
| 2016/0114494 | A1 * | 4/2016 | Carrasco | B26D 5/005 83/14 |

FOREIGN PATENT DOCUMENTS

| | | | |
|---|---|---|---|
| JP | 60-14896 | U | 1/1985 |
| JP | 07-24785 | A | 1/1995 |
| JP | 2004-148708 | A | 5/2004 |
| JP | 2005-230917 | A | 9/2005 |
| JP | 2007-307655 | A | 11/2007 |
| JP | 2009-028860 | A | 2/2009 |
| JP | 2011-230227 | A | 11/2011 |

OTHER PUBLICATIONS

Extended European Search Report for European Application Serial No. 16873071.1 dated Jun. 29, 2018.

* cited by examiner creasing mechanism 1110

SHEET-CUTTING DEVICE, METHOD FOR CUTTING SHEET, AND NON-TRANSITORY COMPUTER READABLE RECORDING MEDIUM

TECHNICAL FIELD

The present disclosure relates to a sheet processing apparatus, a method of processing a sheet, and a computer program.

BACKGROUND ART

A sheet is subjected to cutting processing and creasing processing, and the processed sheet is assembled to be able to use as a package box or a display.

As a method of cutting processing and creasing processing a sheet, generally, there are a method of using a blanking die and a method of using a cutting plotter.

For example, the cutting plotter is described in Patent Literature 1 in which a cut medium is cut to a desired shape by driving the cut medium to a first direction and driving a blade to a second direction orthogonal to the first direction.

Also, a method of cutting material by moving a cutter in an X axial direction and a Y axial direction is described in Patent Literature 2.

CITATION LIST

Patent Literature

Patent Literature 1: Unexamined Japanese Patent Application Kokai Publication No. 2005-230917

Patent Literature 2: Unexamined Japanese Patent Application Kokai Publication No. H07-24785

SUMMARY OF INVENTION

Technical Problem

In the method of using the blanking die, it needs to prepare an exclusive blanking die for each processing, and it is not easy to change the process. This method requires costs such as a production cost and a safekeeping cost of the die, and setup time costs for attaching and detaching the blanking die to and from an automatic blanking apparatus and adjusting it. Therefore, there is a problem of a large cost. Especially, when a small amount of and many kinds of products are to be processed, the cost increases. And, it is difficult to change the process.

Also, in the techniques disclosed in Patent Literatures 1 and 2, one blade is used for the cutting processing, which leads naturally a limit in the speeding-up.

An object of the present disclosure is to provide an apparatus of processing a sheet, a method of processing a sheet, and a computer program, in which the process can be easily changed, and be carried out at high speed in low cost.

Solution to Problem

To achieve the above object, the sheet processing apparatus (1) according to the present disclosure includes:

a first processing section (1000) which forms a plurality of first processing lines (LX1, LX2) extending in a first direction (an X axial direction) on a sheet (4200) as an object to be processed by selectively making a plurality of tools (10, 210) contact with and release from the sheet, and relatively moving the plurality of tools to the first direction with respect to the sheet, at a first position;

a second processing section (2000) which forms a plurality of second processing lines (LY1, LY2), extending in a second direction (a Y axial direction) orthogonal to the first direction on the sheet (4200) by selectively making a plurality of tools contact with and release from the sheet and relatively moving the plurality of tools to the second direction with respect to the sheet, at a second position;

a third processing section (3000) which forms a third processing line (aslant line, curved line) on the sheet, by selectively making a tool (10) contact with and release from the sheet (4200), and relatively moving the sheet and the tool, at a third position;

and a conveyance mechanism which conveys the sheet among the first position, the second position, and the third position.

For example, the first processing section (1000) conveys the sheet to the first direction (the X axial direction) in a condition that positions of the plurality of tools (10, 210) are fixed, wherein the second processing section (2000) moves the plurality of tools (10, 210) to the second direction (the Y axial direction) in a condition that a position of the sheet is fixed, and wherein the third processing section (3000) moves the tool (10) to a two-dimensional direction in a condition that a position of the sheet is fixed.

For example, the first position to the third position are arranged on a straight line, wherein the first processing section (1000) conveys the sheet to a direction parallel to the straight line while fixing the positions of the plurality of tools, wherein the second processing section (2000) moves the tool to a direction approximately orthogonal to the straight line while fixing the position of the sheet, and wherein the third processing section (3000) moves the tool to a direction orthogonal to the straight line and a direction parallel to the straight line while fixing the position of the sheet.

For example, the first processing section carries out first processing while conveying the sheet to the second position or the third position.

For example, the tool comprises:

a blade (10) which cuts the sheet; and an angle control mechanism (120) which controls a direction of the blade, and wherein the processing lines are cutting lines formed by the blade.

For example, the tool comprises a creasing member (210) which forms a crease line, and a direction adjustment mechanism which adjusts a direction of the creasing member pursuantly.

For example, a control mechanism which identifies first processing data to form the first processing lines, second processing data to form the second processing lines, and third processing data to form the third processing line, from processing data of the sheet, may be included. In this case, the first processing section forms the first processing lines based on the first processing data, the second processing section forms the second processing lines based on the second processing data, and the third processing section forms the third processing line based on the third processing data.

In order to achieve the above object, a method of processing a sheet includes:

a first processing step of forming a plurality of first processing lines extending in a first direction on a sheet as an object to be processed in parallel, at a first position, by selectively making a plurality of tools contact with the sheet and release the plurality of tools from the sheet and relatively moving a plurality of tools to the first direction with respect to the sheet;

a second processing step of forming a plurality of second processing lines extending in a second direction orthogonal to the first direction on the sheet at, a second position, by selectively making a plurality of tools contact with the sheet and release the plurality of tools from the sheet and relatively moving a plurality of tools to the second direction with respect to the sheet;

a third processing step of forming a third processing line on the sheet, at a third position, by selectively making a tool contact with the sheet and release the tool from the sheet and relatively moving the sheet and the tool; and a conveyance step of conveying the sheet among the first position, the second position, and the third position.

In order to achieve the above object, a computer program according to the present disclosure makes a computer execute: a step of controlling a driving mechanism for a plurality of tools and conveyance mechanism for a sheet, to form a plurality of first processing lines extending in a first direction on a sheet as an object to be processed, at a first position, by selectively making a plurality of tools contact with the sheet and release the plurality of tools from the sheet and relatively moving the plurality of tools to the first direction with respect to the sheet;

a step of controlling a driving mechanism for a plurality of tools and the conveyance mechanism for the sheet to form the plurality of second processing lines extending in a second direction orthogonal to the first direction on the sheet, at a second position, by selectively making the plurality of tools contact with the sheet and release the plurality of tools from the sheet and relatively moving the plurality of tools to the second direction with respect to the sheet; and a step of controlling a driving mechanism for a tool to form a third processing line on the sheet, at a third position, by selectively making the tool contact with the sheet and release the tool from the sheet and relatively moving the sheet and the tool.

Advantageous Effects of Invention

According to the present disclosure, the processing is possible without using an exclusive blanking die, and the processing shape can be optionally adjusted. And, the setup time can be made small. Also, the processing cost can be restrained. Moreover, since the processing is carried out while using a plurality of tools in parallel, the processing can be sped up.

DESCRIPTION OF EMBODIMENTS

Embodiment 1

A sheet processing apparatus and a method of processing a sheet according to an embodiment of the present disclosure will be described below with reference to the drawings.

Figure 1:
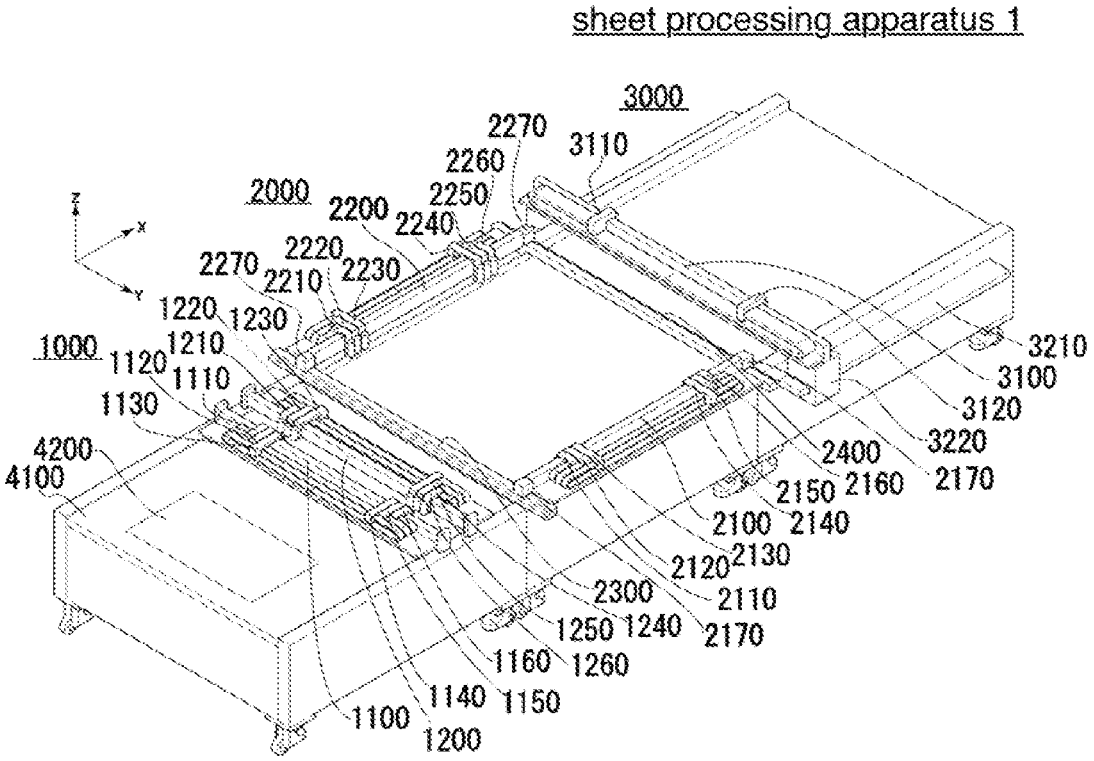
FIG. 1 is a perspective view of a sheet processing apparatus according to an embodiment of the present disclosure.
Figure 2:
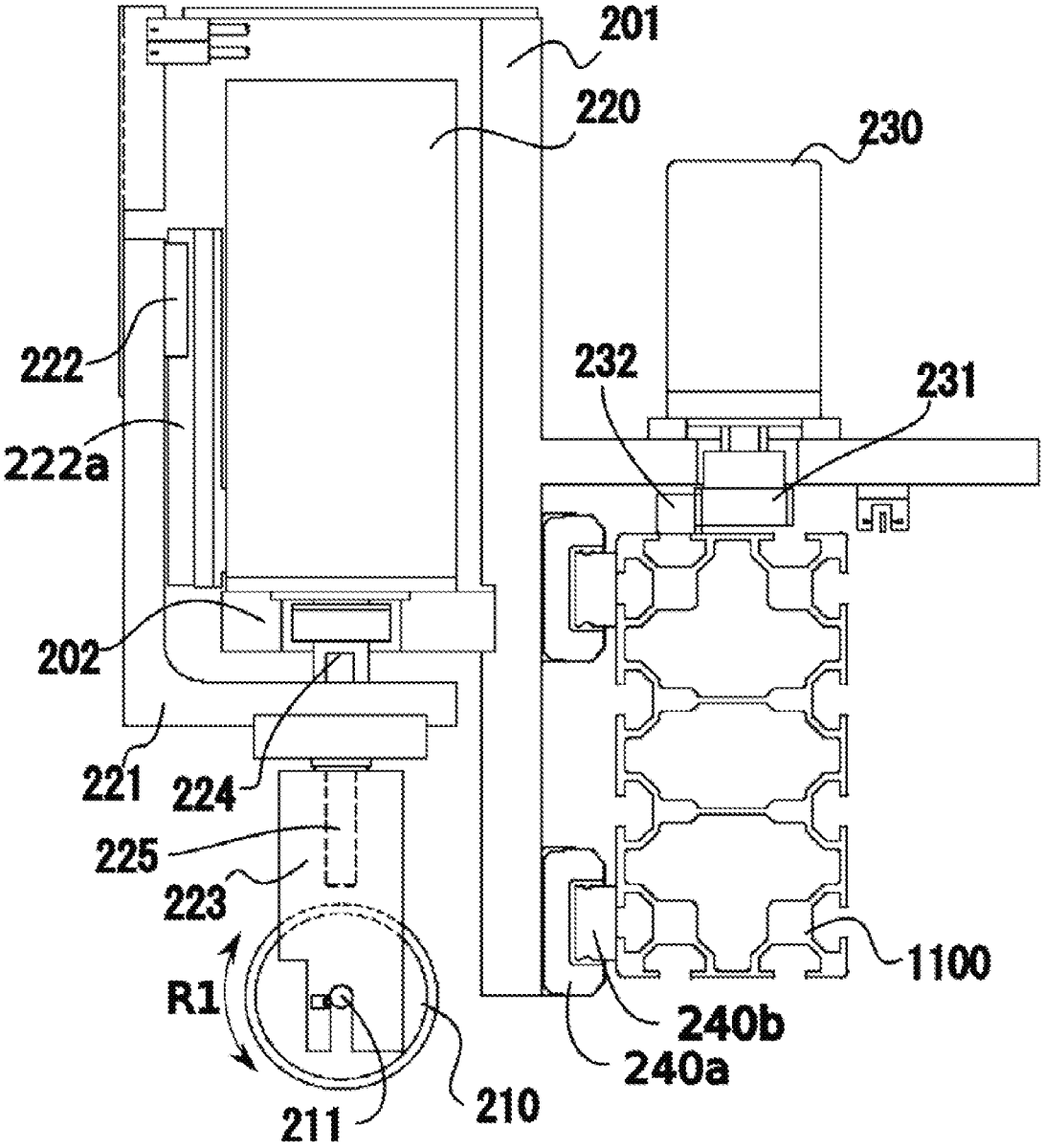
FIG. 2 is a diagram showing the configuration of a creasing mechanism of the sheet processing apparatus shown in FIG. 1.
Figure 3:
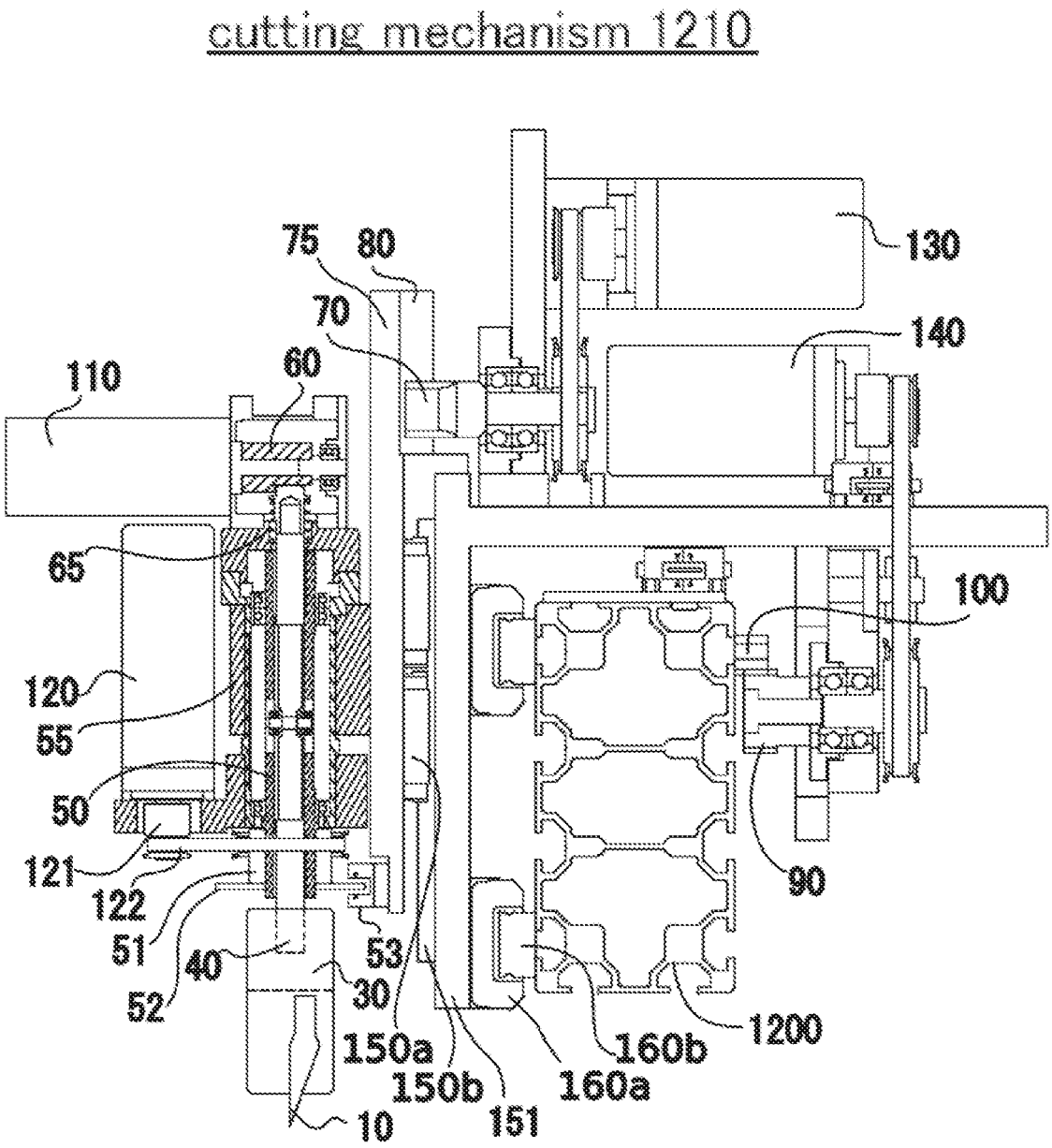
FIG. 3 is a diagram showing the configuration of a cutting mechanism of the sheet processing apparatus shown in FIG. 1.

As shown FIG. 1, a sheet processing apparatus 1 according to this embodiment is an apparatus which carries out cutting processing and creasing processing to a sheet 4200 as an object to be processed, by using tools (a creasing member 210 shown in FIG. 2 and a cutter blade 10 shown in FIG. 3). The sheet processing apparatus 1 includes a first processing section 1000, a second processing section 2000 and a third processing section 3000. The first processing section 1000 to the third processing section 3000 are arranged on a straight line, and while conveying the sheet 4200 from the first processing section 1000 to the third processing section 3000, the sheet processing apparatus 1 sequentially processes as a first processing step, a second processing step, and a third processing step.

In the following explanation, to facilitate understanding, XYZ coordinates are set as shown in FIG. 1 and is referred to appropriately. The X axial direction is a conveyance direction of the sheet 4200, the Y axial direction is a direction orthogonal to the conveyance direction of the sheet 4200 and is parallel to the surface of sheet 4200, and the Z axial direction is a direction perpendicular to the surface of sheet 4200. Note that when being merely referred to as the X axial direction, the Y axial direction, and the Z axial direction, the directions contain the + and − directions of X axis, the + and − directions of Y axis, and the + and − directions of Z axis.

The sheet conveyance mechanisms of the first processing section 1000 to the third processing section 3000 are formed to be flush, and form one carrying surface as a whole. A table 4100 on which the sheet 4200 has been located is conveyed on the carrying surface in a conveyance step. The conveyance mechanism for conveying the table 4100 may be adopting a known optional structure. For example, the conveyance mechanism includes a rack, which is formed in the sheet processing apparatus 1 to extend in the X axial direction, and a pinion formed in the table 4100. The pinion and the rack are engaged with each other. As the pinion rotates, the table 4100 moves to the + and − directions of X axis.

The sheet 4200 is an object to be processed and is arranged at a predetermined location of the table 4100 in a predetermined direction. An example of the sheet 4200 includes a cardboard, a corrugated paper, a resinous film and the like. The shape, size, and material of sheet 4200 are not limited. The minute holes are opened in the surface of table 4100, and the table 4100 has a suction mechanism in its inside. The sheet 4200 is absorbed on the surface of table 4100 by suction force.

In the first processing section 1000, six creasing mechanisms 1110-1160 and six cutting mechanisms 1210-1260 are arranged. The creasing mechanisms 1110-1160 and the cutting mechanisms 1210-1260 process the sheet 4200 being conveyed at a first position where they are arranged.

The creasing mechanisms 1110-1160 push the creasing members against the sheet 4200, to form crease lines (hereinafter, to be referred to as X crease lines) as first processing lines on the sheet 4200 extending in the X axial direction as the first direction.

The creasing mechanisms 1110-1160 are supported by a fixation frame 1100 extending in the Y axial direction. Each of the creasing mechanisms 1110-1160 has a moving mechanism, and is configured to be movable independently to the Y axial direction along the fixation frame 1100. The moving mechanism comprises a rack-and-pinion mechanism, a linear moving mechanism by using a ball screw, a timing belt moving mechanism and the like. The power source of the moving mechanism includes a stepping motor, a servo motor and the like.

The detailed configuration of the creasing mechanisms 1110-1160 will be described with reference to FIG. 2.

FIG. 2 shows the configuration of the creasing mechanism 1110. The creasing mechanisms 1120-1160 have the configuration like the creasing mechanism 1110.

As shown in the figure, the creasing mechanism 1110 includes a frame 201, a bracket 202, a creasing member 210, a roller holding member 223, a guide member 221, an up-down moving motor 220, a slider 222, a rail 222*a*, a lateral moving motor 230, a pinion 231, a rack 232, a slider 240*a* and a rail 240*b*.

The creasing member 210 has a disk structure. The thickness of this disk becomes thin gradually in the outer edge section, and this disk has a shape of sharp edge. The central shaft 211 of the creasing member 210 is held rotatably by the roller holding member 223, and the creasing member 210 is possible to rotate to the direction of R1.

The roller holding member 223 is held by a shaft 224 of the up-down moving motor 220 through the guide member 221. The roller holding member 223 is rotatable around the rotation shaft 225 which is coaxial with the shaft 224. Thus, the creasing member 210 changes direction of it freely, as a direction adjustment mechanism which adjusts the direction of the creasing member according to force received by the creasing member 210. The up-down moving motor 220 has a ball screw mechanism. By rotations of the up-down moving motor 220, the shaft 224 moves to the Z axial direction (the upper or lower direction).

The guide member 221 is fixed to the shaft 224 to extend above along the side surface of up-down moving motor 220. The slider 222 is fixed on the upper end section of guide member 221. The slider 222 is slidably attached to the rail 222*a* which is mounted on the side surface of up-down moving motor 220 to extend in the Z axial direction.

When the slider 222 is moved to the Z axial direction (the upper or lower direction) along the rail 222*a*, the guide member 221 is moved to the Z axial direction, too. When the guide member 221 is moved to the Z axial direction, the creasing member 210 is moved to the Z axial direction, too.

The up-down moving motor 220 is fixed to the frame 201 through the bracket 202. The frame 201 includes an arm section extending in the X axial direction. The lateral moving motor 230 is fixed on this arm section. The pinion 231 is fixed on a rotation shaft of the lateral moving motor 230. The pinion 231 is fixed on the fixation frame 1100, and engages with the rack 232 extending in the Y axial direction. The slider 240*a* is installed to the frame 201. On the other hand, the rail 240*b* is fixed on the fixation frame 1100 extending in the Y axial direction. The slider 240*a* is slidably attached to the rail 240*b*. With this structure, by the rotations of the motor 230, the frame 201 and the creasing member 210 supported by the frame 201 slide to the Y axial direction.

Before starting the creasing processing, a control section (not shown) moves the frame 201 to the + or – direction of Y axis by driving the lateral moving motor 230 to rotate the pinion 231, to arrange the creasing member 210 in the position where the sheet 4200 is subject to the creasing processing. The control section, when starting the creasing processing, drives the up-down moving motor 220 to make the shaft 224 stick out from the main unit of motor 220, so that the creasing member 210 is pushed to the starting point of the creasing processing of the sheet 4200. After that, the control section conveys the table 4100 to the + or – direction of X axis in the condition that the position of the creasing member 210 is fixed (while fixing the creasing member 210). The sheet 4200 as the object to be processed is moved to the X axial direction with conveyance of the table 4100, the creasing member 210 rotates according to the movement of the sheet 4200, to form a crease line on the sheet 4200.

The quantity (the depth) by which the creasing member 210 is pushed into the sheet 4200 needs a fine adjustment depending on the thickness and material of the sheet 4200. In response to a control signal supplied from outside, the control section can adjust the quantity by which the creasing member 210 is pushed into the sheet 4200 by controlling a rotation quantity of the up-down moving motor 220.

The cutting mechanisms 1210-1260 shown FIG. 1 are arranged to the fixation frame 1200 extending in the Y axial direction. Like the creasing mechanisms 1110-1160, the cutting mechanisms 1210-1260 are moved respectively to the position of cutting processing to the Y axial direction along the fixation frame 1200 by the moving mechanism.

The detailed configuration of the cutting mechanisms 1210-1260 will be described with reference to FIG. 3.

FIG. 3 shows the configuration of the cutting mechanism 1210. The cutting mechanisms 1220-1260 have the configuration like the cutting mechanism 1210.

As shown in the figure, the cutting mechanism 1210 includes a cutter blade 10, a cutter folder 30, a cutter shaft 40, a sleeve 50, a pulley 51, a detection board 52, a sensor 53, a housing 55, an eccentric cam 60, a compression spring 65, a vibration motor 110, an angle adjustment motor 120 as an angle adjustment mechanism, a pulley 121, and a timing belt 122.

The cutter blade 10 is detachably attached to the cutter folder 30. The cutter folder 30 is fixed to the cutter shaft 40. The cutter shaft 40 is held in the sleeve 50 to be able to move in a center axial direction thereof (the Z axial direction) only in a predetermined stroke. The sleeve 50 is rotatably held in the housing 55 around the central axis of the cutter shaft 40. The pulley 51 is fixed on the sleeve 50 coaxially. The pulley 51 is connected by the timing belt 122 to the pulley 121 which is coaxially fixed to a rotation axis of the angle adjustment motor 120. The detection board 52 is fixed on the pulley 51, and the sensor 53 detects the detection board 52.

The rotation of the angle adjustment motor 120 rotates the pulley 121. The rotation of pulley 121 rotates the pulley 51 and the sleeve 50 fixed to the pulley 51 through the timing belt 122. The rotation of the sleeve 50 rotates the cutter shaft 40 in the sleeve 50, and the cutter blade 10 held by the cutter folder 30 around the Z axis. A rotation quantity of the cutter blade 10 can be measured by the sensor 53 detecting the detection board 52.

The vibration motor 110 is fixed to the upper part of the housing 55. The eccentric cam 60 is fixed to a rotation shaft of the vibration motor 110. The eccentric cam 60 is arranged at the top of the cutter shaft 40. The cutter shaft 40 is biased upwardly by a compression spring 65 so that its upper end abuts the eccentric cam 60.

When the rotation of the vibration motor 110 rotates the eccentric cam 60, the cutter shaft 40 abutting the eccentric cam 60 is moved to the axial direction of itself. Thus, the cutter blade 10 vibrates in the axial direction of the cutter shaft 40.

The housing 55 is fixed to a base 75. The slider 150*a* is fixed to the base 75. The slider 150*a* extends in the Z axial direction and is slidably held by the rail 150*b* which is fixed on the frame 151. The rack 80 is fixed on the base 75, and extends in the Z axial direction. The pinion 70 engages with the rack 80. The pinion 70 is driven by the up-down moving motor 130 fixed to the frame 151.

When the rotation of up-down moving motor 130 rotates the pinion 70, to move the rack 80 to the Z axial direction. The base 75 is moved to the Z axial direction with the movement of the rack 80 to move the cutter blade 10 held by the base 75 to the Z axial direction.

The slider 160*a* is fixed to the frame 151. On the other hand, the rail 160*b* extending in the Y axial direction is fixed on the fixation frame 1200. The slider 160*a* is slidably attached to the rail 160*b*. Thus, the frame 151 is held by the fixation frame 1200 to be movable to the Y axial direction. The rack 100 is fixed on the fixation frame 1200. The pinion 90 engaging with the rack 100 is connected to the rotation shaft of the lateral moving motor 140 fixed on the frame 151.

The rotation of the lateral moving motor 140 rotates the pinion 90 to move the frame 151 to the Y axial direction along the fixation frame 1200.

Before the cutting processing, the control section (not shown) drives the lateral moving motor 140 to move the frame 151 to the Y axial direction so as to move the cutter blade 10 to a position at which the sheet 4200 is cut. Next, the control section drives the angle adjustment motor 120 to make the direction of the cutter blade 10 matches to a direction of the cutting line to be formed. The control section drives the vibration motor 110 to give the cutter blade 10 a vibration in the Z axial direction. When starting the cutting processing, the control section drives the up-down moving motor 130 to move the cutter blade 10 to the position where the sheet 4200 is cut. After that, the control section moves the sheet 4200 to the X axial direction in the condition that the position of the cutter blade 10 is fixed, so that a cutting line is formed as the first processing line on the sheet 4200 as the object to be processed.

The second processing section 2000 shown in FIG. 1 forms processing lines (hereinafter, to be referred to as Y processing lines) as second processing lines on the sheet 4200 as the object to be processed to extend in the Y axial direction as a second direction. In the second processing section 2000, the sheet 4200 is processed in the condition of staying at a second position.

A couple of fixation frames 2300 and 2400 extending in the Y axial direction are arranged in the second processing section 2000.

The moving frames 2100 and 2200 are arranged to be bridged between the fixation frames 2300 and 2400. The moving frames 2100 and 2200 are movable respectively to the Y axial direction on the fixation frames 2300 and 2400 by the moving mechanisms 2170 and 2270.

The moving frame 2100 includes six creasing members 2110-2160. Each of the creasing members 2110-2160 has the configuration shown in FIG. 2. Each of the creasing members 2110-2160 pushes the creasing member 210 against the sheet 4200 or releases the creasing member 210 from the sheet 4200, and moves to the X axial direction along the moving frame 2100. When the moving frame 2100 moves to the Y axial direction under the condition of pushing the creasing member 210 against the sheet 4200, a crease line is formed on the sheet 4200 as the second processing line to extend in the Y axial direction.

The moving frame 2200 includes six cutting members 2210-2260. Each of the cutting members 2210-2260 has the configuration shown in FIG. 3, and makes the cutter blade 10 pierce the sheet 4200 or release from the sheet 4200, and moves to the X axial direction along the moving frame 2200. When the moving frame 2200 is moved to the Y axial direction, under the condition of the cutter blade 10 piercing the sheet 4200, a cutting line is formed on the sheet 4200 to extend in the Y axial direction.

Note that a processing time can be more reduced, if during the movement of the table 4100 which absorbs the sheet 4200, the mechanisms which process first the sheet 4200 (for example, the rotation roller mechanisms) at the second processing section 2000, have been sent to the origin position of the other mechanisms (e.g. the cutter mechanisms).

The third processing section 3000 shown in FIG. 1 is a processing section for forming aslant or curved cutting lines as a third processing lines to the sheet 4200 as the object to be processed. In the third processing section 3000, the sheet 4200 is processed under the condition of the sheet 4200 stayed at a third position.

The rails 3210 are fixed to both sides of the third processing section 3000. The rails 3210 extend in the X axial direction.

A moving frame 3100 is arranged to be bridged between the rails 3210. The moving frame 3100 includes a driving mechanism 3220, and is formed to be movable on the rail 3210.

The moving frame 3100 includes two cutting members 3110, 3120.

Each of the cutting members 3110 and 3120 has the configuration shown in FIG. 3, and drives the cutter blade 10 to pierce the sheet 4200 or release from the sheet 4200, and to move to the Y axial direction along the moving frame 3100.

Next, the inner configuration of the sheet processing apparatus 1 will be described.

The sheet processing apparatus 1 includes a control mechanism 400 to drive each of the above-mentioned motors.

Figure 4:
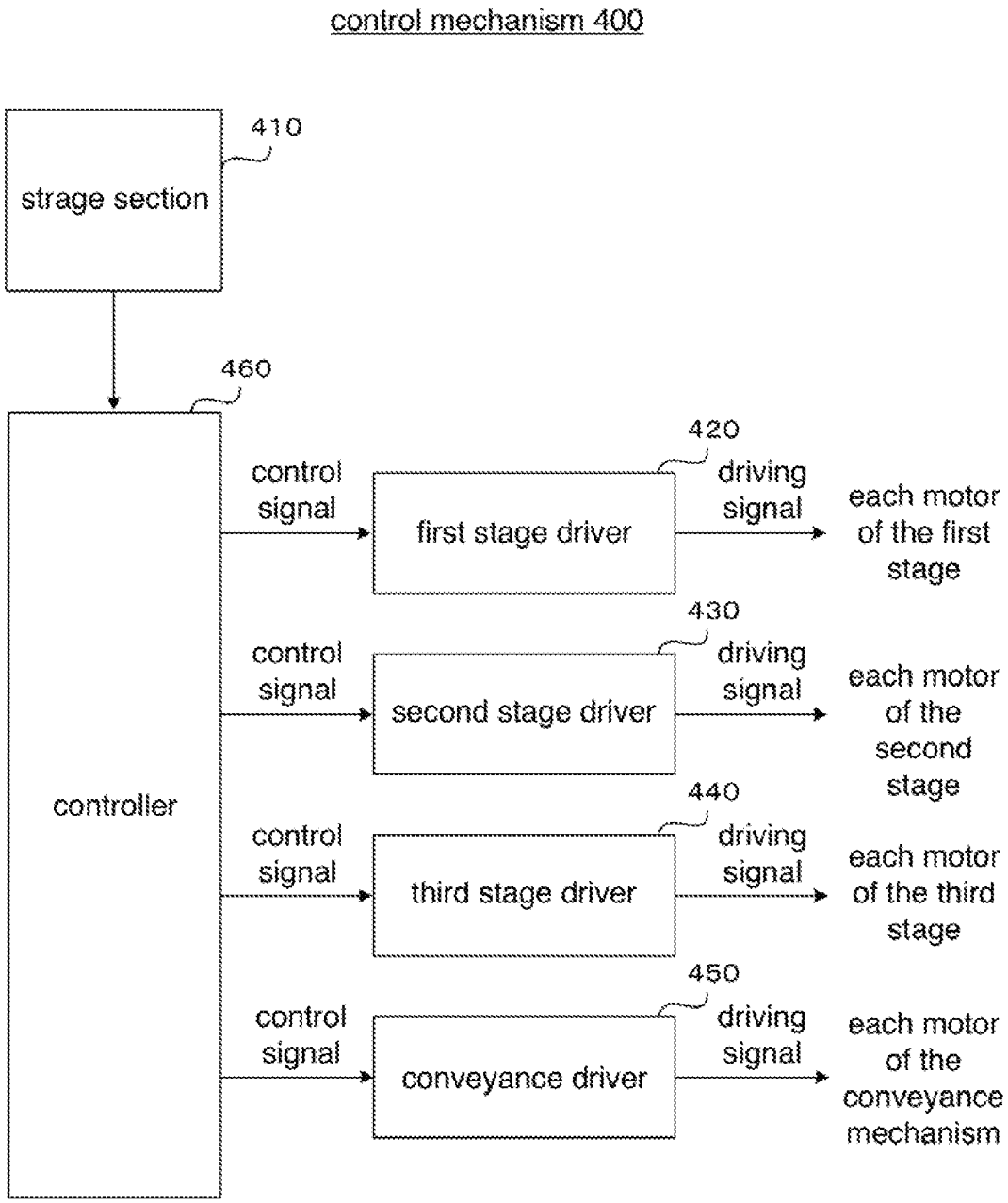
FIG. 4 is a diagram showing the configuration of a control mechanism of the sheet processing apparatus shown in FIG. 1.

As shown in FIG. 4, the control mechanism 400 includes a storage section 410, a first stage driver 420, a second stage driver 430, a third stage driver 440, a conveyance driver 450 and a controller 460.

The storage section 410 stores CAD data which defines the cutting processing and the creasing processing.

The first stage driver 420 drives each motor in the first processing section 1000 according to a control of the controller 460. The motors of the first processing section 1000 include the up-down moving motor 220 and the lateral moving motor 230 of each of the creasing mechanisms 1110-1160, and the vibration motor 110, the angle adjustment motor 120, the up-down moving motor 130, and the lateral moving motor 140 of each of the cutting mechanisms 1210-1260.

The second stage driver 430 drives each motor of the second processing section 2000 according to the control of the controller 460. The motors of the second processing section 2000 include motors which respectively move the moving frames 2100 and 2200 to the Y axial direction, the up-down moving motor 220 and the lateral moving motor 230 of each of the creasing mechanisms 2110-2160, and the vibration motor 110, the angle adjustment motor 120, the up-down moving motor 130, and the lateral moving motor 140 of each of the cutting mechanisms 2210-2260.

The third stage driver 440 drives each motor of the third processing section 3000 according to the control of the controller 460. The motors of the third processing section 3000 include a motor which moves the moving frame 3100 to the X axial direction, the vibration motor 110, the angle adjustment motor 120, the up-down moving motor 130, and the lateral moving motor 140 of each of the cutting mechanisms 3110 and 3120.

The conveyance driver 450 controls a motor of the conveyance mechanism to convey the table 4100.

The controller 460 produces first processing data to third processing data and conveyance data to process the sheet in the first processing section 1000 to the third processing section 3000 and to control the conveyance mechanism, and sends control signals to the first stage driver 420 to the third stage driver 440, which drive the motors arranged in each processing section, and the conveyance driver 450.

More specifically describing, the controller 460 includes a CPU (Central Processing Unit), a RAM (Random Access Memory), a ROM (Read Only Memory), an input/output processor (input/output device) and the like, and is contained in a computer.

The ROM stores a control program for the CPU to execute. This control program is to make the CPU execute the operation to analyze CAD data stored in the storage section 410, and to control each motor of the first processing section 1000 to the third processing section 3000, and the conveyance mechanism based on the analysis result. The details of the control will be described later.

The RAM functions as a work memory of the CPU to store the developed CAD data, a position of the sheet 4200 as the object to be processed, positions of each creasing member 210 and cutter blade 10, and the like.

By executing the program stored in the ROM, the CPU deploys in the RAM, the CAD data stored in the storage section 410, analyzes the deployed CAD data, and classifies processing lines (cutting lines and creasing lines) into processing lines extending in the X axial direction as first processing lines (hereinafter, to be referred to as X processing lines), processing lines extending in the Y axial direction as second processing lines (hereinafter, to be referred to as Y processing lines), and curved or aslant processing lines as third processing lines. Next, the CPU synchronously controls the motors in the first processing section 1000 and the conveyance mechanism through the first stage driver 420 and the conveyance driver 450 based on the data of the X processing lines as the first processing data to form the X processing lines.

Then, the CPU conveys the table 4100 by the conveyance driver 450 based on the conveyance data, to convey the sheet 4200 to the second processing section 2000.

Then, the CPU controls the motors of the second processing section 2000 by the second stage driver 430 based on data of the Y processing lines as the second processing data, to form the Y processing lines.

Then, the CPU conveys the table 4100 by the conveyance driver 450 based on the conveyance data, to convey the sheet 4200 to the third processing section 3000.

Then, the CPU controls each motor of the third processing section 3000 by the third stage driver 440 based on the data of the curved or aslant processing lines as the third processing data, to form the curved or aslant processing lines.

Next, a method of processing a sheet by the sheet processing apparatus 1 having the above mentioned configuration will be described.

Figure 5A:
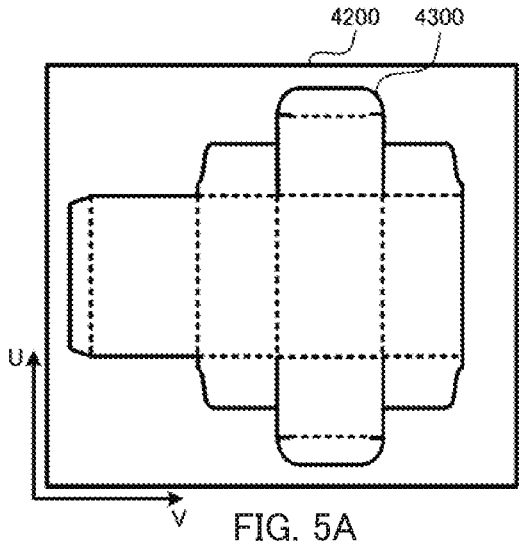
FIGS. 5A to 5D are diagrams showing an example of the processing of a sheet.

To facilitate understanding, as shown in FIG. 5A, it will be described with reference to an example of forming the cutting processing lines and the creasing lines on the sheet 4200 so as to produce a development sheet 4300 of a box from the sheet 4200. Note that in FIG. 5A, the solid lines show the cutting lines, the broken lines show the creasing lines, the whole is equivalent to the development of the box.

Also, the U axis and the V axis are set to orthogonalize based on one corner of the sheet 4200 and are referred appropriately. Also, the sheet 4200 is set on the table 4100 such that the U axis is parallel to the X axis and the V axis is parallel to the Y axis. The controller 460 can get a position of each tool of the sheet processing apparatus 1 on the UV coordinates by a sensor detecting a position of sheet 4200 on the XYZ coordinates in the sheet processing apparatus 1.

First, the CAD data is stored in the storage section 410 to define the process of the development sheet.

Figure 5B:
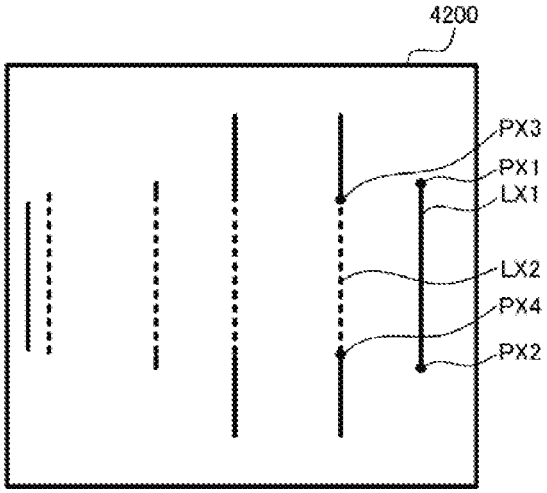
Figure 5C:
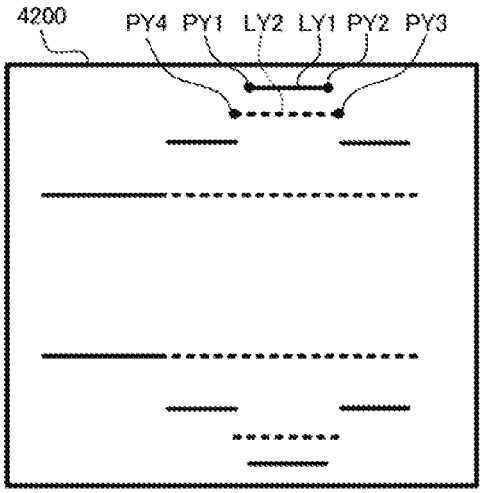

The controller 460 analyzes the CAD data to extract the X processing lines extending in the X axial direction as the first processing lines schematically shown in FIG. 5B and the Y processing lines extending in the Y axial direction as the second processing lines schematically shown in FIG. 5C. The remaining processing lines are curved/aslant processing lines as the third processing lines shown in FIG. 5D.

The controller 460 allocates the creasing mechanisms 1110-1160 and the cutting mechanisms 1210-1260 in the first processing section 1000 for forming of the creasing lines and the cutting lines shown in FIG. 5B. In this case, it is supposed that the cutting mechanism 1260 is allocated for forming of a cutting line LX1 and the creasing mechanism 1160 is allocated for forming of a crease line LX2. Also, the controller 460 decides a starting point and a terminal point of each processing line.

Next, the controller 460 allocates the creasing mechanisms 2110-2160 and the cutting mechanisms 2210-2260 in the second processing section 2000 for forming of the Y crease lines and the Y cutting lines shown in FIG. 5C. In this case, it is supposed that the cutting mechanism 2260 is allocated for forming of the Y cutting line LY1, and the creasing mechanism 2160 is allocated for forming of the Y crease line LY2. Also, the controller 460 decides a starting point and a terminal point of each processing line.

Figure 5D:
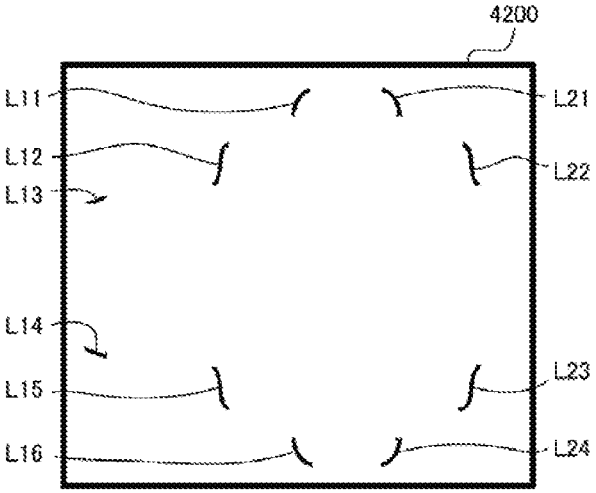

In the same way, the controller 460 allocates a cutting member in the third processing section 3000 for each cutting line shown in FIG. 5D. Also, the controller 460 decides a starting point and a terminal point of each processing line.

The controller 460 determines a position on the XYZ coordinates in the sheet processing apparatus 1 by a sensor for the sheet 4200. The controller 460, since grasping a position of each tool on the XYZ coordinates, can determine a position of each tool on the UV coordinates through the coordinate transformation.

Next, the sheet 4200 as the object to be processed is arranged on the table 4100. The sheet 4200 is fixed on the table 4100 by a suction mechanism of the table 4100.

The controller 460 moves each of the creasing mechanisms 1110-1160 along the fixation frame 1100 through the first stage driver 420 so as to be positioned on a forming position of a corresponding X crease line in the Y axial direction. In the same way, the controller 460 moves each of the cutting mechanisms 1210-1260 along the fixation frame 1200 through the first stage driver 420 to be positioned on a forming position of a corresponding X cutting line in the Y axial direction. In an example of FIG. 5, the creasing mechanism 1160 is moved to a position on an X crease line LX2 in the Y axial direction, and the cutting mechanism 1260 is moved to a position of X cutting line LX1 in the Y axial direction.

On the other hand, the controller 460 drives the conveyance mechanism through the conveyance driver 450, to convey the table 4100 for the creasing mechanisms 1110-1160 and the cutting mechanisms 1210-1260.

The controller 460 determines whether or not the start point of each X crease line on the sheet 4200 reached a position of the member 210 of the creasing mechanisms 1110-1160 allocated for an X crease line. When judging that it has reached the position, the controller 460 drives the motor 220 of each of the creasing mechanisms 1110-1160 to push the creasing member 210 against the sheet 4200. A direction of the creasing member 210 becomes the X axial direction with conveyance of the sheet 4200.

After that, the creasing member 210 pushes the sheet 4200, and by conveyance of the sheet 4200 to the X axial direction, a crease line is formed to extend in the X axial direction.

The controller 460 determines whether or not a terminal point of each X crease line on the sheet 4200 has reached the position of the member 210 of each of the creasing mechanisms 1110-1160 allocated for the X crease line. When judging that it has reached the position, the controller 460 drives the motor 220 of each of the creasing mechanisms 1110-1160 to release the creasing member 210 from the sheet 4200, and moves it to a non-processing position. Thus, the crease line is formed on the sheet 4200 to extend in the X axial direction from the start point to the terminal.

In the same way, the controller 460 determines whether or not a start point of each X cutting line on the sheet 4200 has reached a position of the cutter blade 10 in each of the cutting mechanisms 1210-1260 allocated for the X cutting line. When judging that it has reached the position, the controller 460 drives the up-down moving motor 130 of each of the cutting mechanisms 1210-1260 for the cutter blade 10 to pierce the sheet 4200. Also, the controller 460 drives the angle adjustment motor 120 to direct the direction of the cutter blade 10 to the – direction of X axis. Moreover, the controller 460 drives the vibration motor 110 to vibrate the cutter blade 10 up and down.

After that, the cutter blade 10 cuts the sheet 4200 vibratingly, and the cutting line is formed on the sheet 4200 to extend in the X axial direction.

When judging that a terminal point of each X cutting line on the sheet 4200 has reached the position of the cutter blade 10 of each of the cutting mechanism 1210-1260 allocated for the X the cutting line, the controller 460 drives the up-down moving motor 130 in each of the cutting mechanisms 1210-1260 to release the cutter blade 10 from the sheet 4200, and moves it to a non-processing position. Thus, the crease line is formed on the sheet 4200 to extend in the X axial direction from the start point to the terminal. Then, the controller 460 stops the vibration motor 110.

In the example of FIG. 5, when a start point PX1 of the cutting line LX1 has reached a position of the cutter blade 10 of the cutting mechanism 1260, the controller 460 drives the up-down moving motor 130 for the cutter blade 10 to pierce the sheet 4200. Note that a direction of the cutter blade 10 is previously directed to the direction of the X axis. Thus, the sheet 4200 is cut by the cutter blade 10. Thereafter, when a terminal point PX2 of the cutting line LX1 on the sheet 4200 has reached the position of the cutter blade 10 of the cutting mechanism 1260, the controller 460 drives the up-down motor 230 to release the cutter blade 10 from the sheet 4200. Thus, the cutting line LX1 is formed on the sheet 4200 to extend in the X axial direction.

In the same way, when a start point PX3 of the crease line LX2 on the sheet 4200 has reached a position of the creasing member 210 of the creasing mechanism 1160, the controller 460 drives the up-down moving motor 220 to push the creasing member 210 against the sheet 4200. Thus, the crease line is formed on the sheet 4200 by the creasing member 210. On the other hand, when a terminal point PX4 of the crease line LX2 on the sheet 4200 has reached the position of the creasing member 210 of the creasing mechanism 1160, the controller 460 drives the up-down moving motor 220 to release the creasing member 210 from the sheet 4200. Thus, the crease line LX2 is formed on the sheet 4200 to extend in the X axial direction.

When it finishes conveying the table 4100 on the first processing section 1000, it completes to form a vertical processing line on the sheet 4200.

In this way, while conveying the sheet 4200 from the first processing section 1000 to the second processing section 2000, the processing of the sheet 4200 completes.

Note that, when all of the crease lines and the cutting lines could not be formed by once conveyance of the table 4100, the table 4100 is returned to a reference position on the first processing section 1000, and while moving the table 4100 to the X axial direction, the remaining processing lines are formed.

Also, a process may be carried out when conveying the sheet 4200 to the – direction of the X axial. In this case, the controller 460 controls the angle adjustment motor 120 by the first stage driver 420 to direct the cutter blade 10 to the + direction of the X axis. Also, the creasing member 210 rotates according to the movement of the sheet 4200 to change the direction of it.

In this way, when the sheet 4200 (the table 4100) is moved to a predetermined position of the second processing section 2000, it completes to carry out the processing of the X crease lines and the X cutting lines on the sheet 4200.

Then, the controller 460 conveys the table 4100 to the reference position of the second processing section 2000.

Then, the controller 460 controls the lateral moving motor 230 of each of the creasing mechanisms 2110-2160 through the second stage driver 430 to move each creasing member 210 to a position on the X coordinate of a Y crease line for which the creasing member 210 is allocated. In the same way, the controller 460 drives the lateral moving motor 140 by the second stage driver 430 to move each cutter blade 10 to a position on an X coordinate of a corresponding Y cutting line.

Next, the controller 460 drives the moving mechanism 2170 by the second stage driver 430 in the condition of fixing the table 4100, to move the moving frame 2100 to the – direction of Y axis along the fixation frame 2300.

When judging that each creasing member 210 has reached a start point of the corresponding Y crease line, the controller 460 drives the motor 220 of each of the creasing mechanism 2110-2160 to push the creasing member 210 against the sheet 4200. After that, in the condition of pushing the creasing member 210 against the sheet 4200, the moving frame 2100 is moved to the – direction of Y axis to form the crease line to extend the Y axial direction. When the creasing member 210 has reached a terminal point of a lateral crease line which is being formed, the controller 460 drives the up-down moving motor 220 to release the creasing member 210 from the sheet 4200. Thus, the crease line is formed on the sheet 4200 to extend in the Y axial direction from the start point to the terminal.

When finishing the formation of crease lines, the controller 460 returns the moving frame 2100 to a home position.

Then, the controller 460 drives the moving mechanism 2270 by the second stage driver 430 in the condition of fixing the table 4100 to move the moving frame 2200 to the + direction of the Y axis along the fixation frames 2300 and 2400. Also, the controller 460 drives the angle adjustment motor 120 of each of the cutting mechanisms 2210-2260 to direct the cutter blade 10 to the + direction of the Y axis.

When judging that each creasing member 210 has reached a start point of a corresponding Y crease line, the controller 460 drives the up-down moving motor 130 of each of the cutting mechanisms 2210-2260 for the cutter blade 10 to pierce the sheet 4200. Also, it drives the vibration motor 110 to vibrate the cutter blade 10 up and down.

After that, in the condition for the cutter blade 10 to pierce the sheet 4200 and move up and down, the moving frame 2200 moves to the + direction of Y axis to form a cutting line to extend in the Y axial direction. When the cutter blade 10 has reached a terminal point of the cutting line, the controller 460 drives the up-down moving motor 130 to release the cutter blade 10 from the sheet 4200. Also, it stops the vibration motor 110. Thus, the cutting line is formed on the sheet 4200 to extend in the Y axial direction from the start point to the terminal.

The controller 460 returns the moving frame 2200 to a home position, when finished the formation of cutting lines.

Referring to the example of FIG. 5, when the creasing member 210 of the creasing mechanism 2160 has reached a start point PY3 of the creasing line LY2 through the movement of the moving frame 2100, the controller 460 pushes the creasing member 210 against the sheet 4200. When the creasing member 210 of the creasing mechanism 2160 has reached a terminal point PY4 of the creasing line LY2, the controller 460 releases the creasing member 210 from the sheet 4200. Thus, the crease line LY2 is formed.

When completing the formation of the crease lines, the controller 460 moves the moving frame 2200 to the + direction of Y axis. When the cutter blade 10 directing to the + direction of Y axis, of the cutting mechanism 2260 has reached the start point PY1 of the cutting line LY1, the controller 460 controls the cutter blade 10 to pierce the sheet 4200. When the cutter blade 10 of the cutting mechanism 2260 has reached the terminal point PY2 of the cutting line LY1, the controller 460 releases the cutter blade 10 from the sheet 4200. Thus, the cutting line LY1 is formed.

When the formation of all of the Y crease lines and the Y cutting lines completes, the table 4100 is moved to the reference position of the third processing section 3000 in the condition of fixing the sheet 4200.

The controller 460 carries out the cutting processing of the aslant cutting lines and the curved cutting lines on the sheet 4200 in the third processing section 3000. Specifically, the controller 460 drives the moving mechanism 3220 by the third stage driver 440 to move the moving frame 3100 to the X axial direction and to move the cutting mechanisms 3110 and 3120, which are synchronized with each other, along the moving frame 3100. Moreover, the controller 460 drives the angle adjustment motor 120 to control the direction of the cutter blade 10 so as to match the inclination of the cutter blade 10 at a current position on the cutting line to be formed.

Moreover, the controller 460 pushes down the cutter blade 10 on a start point of the cutting line by the third stage driver 440, to pierce the sheet 4200, and draws up the cutter blade 10 on a terminal point to release it from the sheet 4200. Also, during the cutting, the cutter blade 10 is vibrated. Moreover, during the cutting, the controller 460 drives the angle adjustment motor 120 to control the direction of the cutter blade 10 so as to match the direction of the cutter blade 10 with an inclination at a current position of the forming the cutting line.

In this way, through the operation of moving the sheet 4200 relatively to a two-dimensional direction of X and Y, the controller 460 forms the aslant cutting lines and the curved cutting lines.

In the example shown in FIG. 5, the cutting mechanism 3110 is allocated for the curved cutting lines L11, L12, L15, and L16 and the aslant cutting lines L13 and L14, and the cutting mechanism 3120 is allocated for the curved cutting lines L21, L22, L23, and L24. Next, the controller 460 moves the cutting mechanisms 3120 and 3110 along the moving frame 3100 while moving the moving frame 3100 to the X axial direction, adjusts the direction of the cutter blade 10, and forms each cutting line by controlling an up and down operation of the cutter blade 10

Note that when a process finishes, the sheet 4200 is transferred to the device on the next stage (not shown), and the table 4100 is returned to the home position shown in FIG. 1. Alternatively, after the process has finished, the table 4100 is returned to the home position shown in FIG. 1, and the processed sheet 4200 is received by the other apparatus.

In this way, the sheet processing apparatus 1 of the present embodiment classifies processing lines into processing lines extending in the X axial direction, processing lines extending in the Y axial direction, and the other processing lines, and the processing lines are processed in parallel by a plurality of processing mechanisms. Therefore, the sheet 4200 can be processed at high speed.

Note that in this embodiment, only the processing lines extending in the X axial direction are processed at the first processing section 1000. But, the present disclosure is not limited to this, and aslant processing lines and/or curved processing lines might be formed if an angle between the X axial direction and the processing line is within a predetermined angle, e.g. about 25 degrees or less. For example, the aslant or curved crease lines may be formed, by moving the creasing mechanisms 1110-1160 to the Y axial direction while moving the table 4100 to the X axial direction. In the same way, the aslant or curved cutting lines may be formed, by moving the cutting mechanisms 1210-1260 to the Y axial direction while moving the table 4100 to the X axial direction. In this case, it is desirable to control a rotation angle of the cutter blade 10 in synchronization (harmonious) with the movement of the cutter mechanisms 1210-1260.

Also, in this embodiment, only the processing lines extending in the Y axial direction are processed in the second processing section 2000. But, the present disclosure is not limited to this, and the aslant processing lines and/or the curved processing lines might be formed if an angle between the Y axial direction and the processing line is within a predetermined angle, e.g. about 25 degrees or less. For example, the aslant or curved crease lines may be formed, by moving each of the creasing mechanisms 2110-2160 to the Y axial direction while moving the moving frame 2100 to the Y axial direction. In the same way, the aslant or curved cutting lines may be formed, by moving the cutting mechanisms 2210-2260 to the X axial direction while moving the moving frame 2200 to the X axial direction. In this case, it is desirable to control the rotation angle of the cutter blade 10 in synchronization (harmonious) with the movement of the cutter mechanisms 2210-2260 to the X axial direction.

In this embodiment, crease processing is not carried out at the third processing section 3000, but it is possible to arrange the creasing mechanism. In this case, a frame is arranged to move on the rail 3210 to the X axial direction, and the creasing mechanism moving to the Y axial direction is arranged at this frame.

A sequence is optional in which the first processing section 1000 to the third processing section 3000 are arranged. For example, the sequence may be in the order from the third processing 3000 to the first processing section 1000.

Also, the sheet 4200 is conveyed in the condition of fixing tools (cutter blade 10, the creasing member 210) in the first processing section 1000, but like second processing section 2000, the tools may be moved to the X axial direction in the condition of fixing the sheet 4200.

Embodiment 2

In embodiment 1, the sheet processing apparatus 1 has been described in which the sheet 4200 is processed in different places such as the first processing section 1000, the second processing section 2000, and the third processing section 3000. The present disclosure is not limited to this. In the identical place, it is possible to form the X processing lines, the Y processing lines, the aslant processing lines, and the curved processing lines.

In this case, for example, it is possible to achieve by using only the configuration of the second processing section 2000 in embodiment 1.

In this case, the sheet 4200 to be processed as is fixed on the table 4100 which is fixed on the second processing section 2000.

First, the X processing lines (or Y processing lines) are formed.

Next, the table 4100 is rotated by 90 degrees, or the sheet 4200 as the object to be processed is rotated by 90 degrees.

Next, the Y processing lines (or X processing lines) are formed.

Next, the aslant processing lines and the curved processing lines are formed while one or two of the creasing mechanisms and/or the cutting mechanisms are moved to the X axial direction and the Y axial direction. In this way, it completes to process the sheet 4200 as the object to be processed.

Modified Embodiments

In embodiment 1 and embodiment 2 examples in which the cut sheet 4200 is processed are shown, but a continuous paper may be processed. In case of processing the continuous paper, the X processing lines are formed in the first processing section 1000 while the continuous paper is conveyed; after stopping the conveyance, the Y processing lines are formed in the second processing section 2000; moreover, after the conveyance, the aslant/curved processing lines are formed in the third processing section 3000.

In case of processing the continuous paper, in configuration of embodiment 1, the X processing lines are formed in the first processing section 1000 while the continuous paper is conveyed; after stopping the conveyance, the Y processing lines are formed in the second processing section 2000; moreover, after the conveyance, the aslant/curved processing lines are formed in the third processing section 3000.

Also, in the above mentioned embodiments, the sheet 4200 is fixed on the table 4100 by absorbing. The technique of fixing the sheet 4200 on the table 4100 is optional. For example, it is possible to adopt techniques of using an adhesion material to fix the sheet 4200 as the object to be processed on the table 4100 or fastening an edge of the sheet 4200 as the object to be processed with a clip formed on the table 4100 to fix the sheet 4200, and the like.

In the above mentioned embodiments, the controller 460 extracts data of processing lines in the X axial direction as first processing data, data of processing lines in the Y axial direction as second processing data, and data of other processing lines as third processing data from CAD data. The present disclosure not being limited to this, and data of previously classified processing lines may be supplied to the controller 460 from outside.

INDUSTRIAL APPLICABILITY

The present disclosure is available for a field which processes a sheet made of paper and resin, and can use to manufacture container packing and a sheet-shape part.

REFERENCE SIGNS LIST

1 Sheet processing apparatus
10 Cutter blade
40 Cutter shaft
60 Eccentric cam
65 Compression spring
70, 90, 231 Pinion
80, 100, 232 Rack
110 Vibration motor
120 Angle adjustment motor
130 Up-down moving motor
140 Lateral moving motor
210 Creasing member
220 Up-down moving motor
230 Lateral moving motor
1100, 1200, 2300, 2400 Fixation frame
2100, 2200, 3100 Moving frame

The invention claimed is:

1. A sheet processing apparatus comprising:

a first processing section which forms a plurality of first processing lines, extending in a first direction (an X axial direction) on a sheet as an object to be processed by selectively making a plurality of tools contact with and release from the sheet, and relatively moving the plurality of tools to the first direction with respect to the sheet, at a first position, the plurality of tools comprising a plurality of first blades to cut the sheet;

a second processing section which forms a plurality of second processing lines, extending in a second direction (a Y axial direction) orthogonal to the first direction on the sheet by selectively making a plurality of tools contact with and release from the sheet and relatively moving the plurality of tools to the second direction with respect to the sheet, at a second position, the plurality of tools comprising a plurality of second blades to cut the sheet;

a third processing section which forms a third processing line that is an aslant line or a curved line, on the sheet, by making a third blade contact with and release from the sheet, and relatively moving the sheet and the blade, at a third position, the blade being configured to cut the sheet;

a conveyance mechanism which conveys the sheet among the first position, the second position, and the third position;

an up-down moving motor which causes a movement of the blade which cuts the sheet in a third direction (a Z axial direction) orthogonal to the first direction and the second direction; and an angle adjustment motor which causes a rotation of the blade about an axis along the third direction, wherein the first processing section, the second processing section, and the third processing section are operable independently of each other and in parallel.

2. The sheet processing apparatus according to claim 1, wherein the conveyance mechanism in the first processing section conveys the sheet in the first direction (the X axial direction) while fixing positions of the plurality of tools, wherein the second processing section moves the plurality of tools in the second direction (the Y axial direction) while fixing a position of the sheet, and wherein the third processing section moves the third blade parallel to the sheet while fixing a position of the sheet.

3. The sheet processing apparatus according to claim 2, wherein the first position to the third position are arranged on a straight line, wherein the conveyance mechanism in the first processing section conveys the sheet in a direction parallel to the straight line while fixing the positions of the plurality of tools, wherein the second processing section moves the second blades in a direction approximately orthogonal to the straight line while fixing the position of the sheet, and wherein the third processing section moves the third blade to a direction orthogonal to the straight line and a direction parallel to the straight line while fixing the position of the sheet.

4. The sheet processing apparatus according to claim 3, wherein the first processing section carries out first processing while the conveyance mechanism conveys the sheet to the second position or the third position.

5. The sheet processing apparatus according to claim 2, wherein the first processing section carries out first processing while the conveyance mechanism conveys the sheet to the second position or the third position.

6. The sheet processing apparatus according to claim 1, further comprising:

a vibration mechanism which reciprocates the third blade in a back and forth motion along the third direction.

7. The sheet processing apparatus according to claim 1, wherein the plurality of tools include a tool which comprises:

a creasing member which forms a crease line; and a direction adjustment mechanism which adjusts a direction of the creasing member pursuantly.

8. The sheet processing apparatus according to claim 1, further comprising:

a control mechanism which identifies first processing data to form the first processing lines, second processing data to form the second processing lines, and third processing data to form the third processing line, from processing data of the sheet, wherein the first processing section forms the first processing lines based on the first processing data, wherein the second processing section forms the second processing lines based on the second processing data, and wherein the third processing section forms the third processing line based on the third processing data.

* * * * *